US006155346A

United States Patent [19]

Aldridge

[11] Patent Number: 6,155,346

[45] Date of Patent: Dec. 5, 2000

[54] DOWNHOLE ANCHOR

[75] Inventor: Colin A. Aldridge, Okotoks, Canada

[73] Assignee: Kudu Industries Inc., Calgary, Canada

[21] Appl. No.: 09/272,741

[22] Filed: Mar. 9, 1999

[30] Foreign Application Priority Data

Jun. 19, 1998 [CA] Canada ..... 2241358

[51] Int. Cl.[7] ..... E21B 23/01

[52] U.S. Cl. ..... 166/216; 166/243

[58] Field of Search ..... 166/216, 217, 166/243

[56] References Cited

U.S. PATENT DOCUMENTS 3,322,006 5/1967 Brown ..... 81/57
3,380,528 4/1968 Timmons ..... 166/216
5,350,013 9/1994 Jani et al. ..... 166/217
5,771,970 6/1998 Jani ..... 166/216
6,062,309 5/2000 Gosse ..... 166/216

*Primary Examiner*—Hoang Dang
*Attorney, Agent, or Firm*—Bennett Jones LLP

[57] ABSTRACT

A downhole anchor for preventing rotational movement of a member within a well has a central tubular member, a slip housing and a drag assembly disposed about the tubular member. The slip housing carries at least two slip members, each slip member being mounted in a slot for slide-in positioning. This slip mounting feature facilitates assembly and refurbishment of the anchor. The slips are inwardly biased toward the tubular member by a spring acting between the slip members and the tubular member. The positioning of the spring in this way also facilitates assembly and refurbishment of the anchor and reduces stress damage to the slip housing.

19 Claims, 4 Drawing Sheets

DOWNHOLE ANCHOR

FIELD OF THE INVENTION

The present invention relates to an anchor which prevents rotation of a member, such as a tubing string, within a well.

BACKGROUND OF THE INVENTION

The drive rods of progressive cavity pumps, also known as screw-type pumps, tend to impart torque to the pump during operation. This torque causes both the pump and the tubing string to rotate in a right hand direction, when viewed from the top. Such rotation is detrimental to the pumping operation.

An anchor is known for use with a progressive cavity pump and is described in U.S. Pat. No. 4,811,785 issued Mar. 14, 1989 to Weber. This anchor has a drag assembly and a slip assembly disposed about a central tubular member though which the well fluids can pass. The drag assembly carries a drag means, such as spring-biased drag blocks or belly-type springs, and is free to rotate relative to the tubular member. The slip assembly is formed about the tubular member in engagement with the drag assembly. The slip assembly houses slip members having casing engaging surfaces, which are driven between a retracted position and an extended engaging position by action of the drag and slip assemblies rotating about the central tubular member and slip members moving over the surface of the tubular member where it is formed as a mandrel.

This anchor, and particularly the slip housing and slip members of the anchor, are quite complex and difficult to assemble. This factor makes initial manufacture, refurbishment and repair expensive and undesirable. In addition, the slips are mounted in the slip housing in such a way that causes premature wear and failure of the anchor.

SUMMARY OF THE INVENTION

An anchor for use with a progressive cavity pump has been invented which is easier to assemble and refurbish over prior art anchors. The present anchor also imparts less stress on the slip housing than prior art anchors which reduces stress related damage of the slip housing.

In accordance with a broad aspect of the present invention, there is provided a downhole tool for preventing rotational movement of a member within a well comprising an elongate tubular member having a central axis; a drag housing carrying drag means and being mounted on and rotatable about the tubular member; a slip housing disposed about the tubular member and secured to the drag housing to rotate with the drag housing about the tubular member, the slip housing including at least two slots extending from an edge thereof, each slot including an open end and a closed end and a open face opening to the outer surface of the slip housing, each slot retaining a slip member, each slip member being normally biased inwardly toward the tubular member and cam means on the outer surface of the tubular member including an outwardly extending cam surface for each slip member, the slip housing positioned over the cam means so that the cam surfaces can ride under the slip members to urge them radially outwardly through the slots.

In accordance with a broad aspect of the present invention, there is provided a downhole tool for preventing rotational movement of a member within a well comprising an elongate tubular member having a central axis; a drag housing carrying drag means and being mounted on and rotatable about the tubular member; a slip housing disposed about the tubular member and secured to the drag housing to rotate with the drag housing about the tubular member, the slip housing including a plurality of slots each slot retaining a slip member, the slip member each being biased inwardly toward the tubular member by biasing means acting between the slip members and the tubular member and being retained in the slot to move with the slip housing and cam means on the outer surface of the tubular member including an outwardly extending cam surface for each slip member, the slip housing positioned over the cam means so that the cam surfaces can ride under the slip members to urge them radially outwardly through the slots.

DESCRIPTION OF THE INVENTION

The invention provides an anchor for use in preventing the rotation of a downhole member such as a pump or a tubing string, within a well. The anchor is positionable within the well about the member to be anchored. Alternately, the anchor can be incorporated into the member to be anchored. The anchor is particularly useful to act against a stationary well structure, such as the well casing or borehole wall, to prevent vibration of a progressive cavity pump which produces torque in a right hand direction during use.

The anchor preferably has a central tubular member which is attachable to a pump or which can be inserted in-line into a production tubing string. The tubular member has a bore along its central axis for the passage of production fluids, such as oil and water, and ends suitably adapted, such as by threading, for connection to other tube members, coupling rings or pumps. The outer surface of the tubular member supports a drag assembly and a slip assembly and has formed thereon a plurality of cam surfaces over which the slip assembly is positioned.

The drag assembly is mounted on the tubular member in such a way that it can rotate about the central axis of the tubular member and includes a drag housing which carries a suitable number of drag means. As an example, the drag means introduce drag between the drag housing and the well casing through frictional contact.

Frictional drag action can be accomplished by drag means such as, for example, outwardly spring-biased drag blocks or belly-type springs mounted on the drag assembly. At least two drag means are preferably provided so that the tube segment is approximately centred in the casing and is not squeezed against one side of the casing. A preferred drag assembly has three drag means equidistantly spaced about the tool circumference. The drag means comprise, for example, three outwardly spring biased drag blocks. The drag means act to engage the well casing frictionally, when the anchor is placed in the well. The force of frictional engagement between the drag means and the well casing is selected so that the positioning of the drag means, and thereby the drag assembly, will be maintained during application of the degree of torque which is applied during operation of a progressive cavity pump, but is also selected such that it can be overcome by application of a reasonable amount of force.

The drag means can be mounted in the housing in any suitable way. Preferably, the drag means are mounted in the housing so that they can be removed for repair or replacement, if necessary. In one embodiment, open ended slots are formed which extend from an edge of the housing into which the drag means can be inserted. The drag means, once inserted into the slot engage behind a flange extending over a portion of the slot open face and a retaining means can be secured over the open end of the slot.

The slip assembly is mounted on the tubular member and secured to the drag assembly in such a way that it can rotate with the drag assembly about the central axis of the tubular member. The slip assembly includes a slip housing which carries at least two slip members. In a preferred embodiment, three slip members are spaced equally about the circumference of the housing. Preferably, the slip members are biased radially inwardly toward the tubular member. In one preferred embodiment, the slip members are acted upon by a tension spring which acts between the tubular member and the slip members to draw the slip members inwardly toward the tubular member. The use of a tension spring between the tubular member and slip members facilitates assembly and disassembly and decreases the application of force on the slip housing, of the present anchor over previous anchors having spring biased slip members with springs acting between the inner surface of the slip housing and the slip members. Preferably, the springs are carried by the slip members so that they can be inserted with the slip members. In one embodiment, one spring is provided which acts for all slip members.

The slip members are mounted in the slip housing so that they can be removed easily for repair or replacement, if necessary. In one embodiment, open ended slots are formed which extend from an edge of the housing and into which the slip members can be inserted. The slip members, once inserted into their slots, are maintained in the slot by abutment against the sidewalls and a retaining means can be secured over the open end of the slot. The provision of such a slip assembly facilitates assembly and refurbishment of the anchor.

Preferably the width of each slip member is selected to conform to the width of the slot into which it is mounted so that stresses are transferred efficiently between the slip members and the housing.

The teeth of the slip members are preferably formed to enhance their engagement against surfaces such as casing steel. For example, the teeth of the slip members can be formed with sharpened serrations.

The slip housing is positioned over the tubular member over the region having outwardly extending cams. There is one cam for each slip member and the slips are mounted to be acted upon by the cams should they be rotated over their respective cams.

In use, the anchor is placed to prevent rotation of a member, such as a section of tubing, against rotation in a preselected direction. The anchor is placed in the well such that the tubular member is in communication with the member to be anchored. For example, the tubular member can be inserted into the tubing string. The anchor is further positioned such that the drag means frictionally contact against the well casing. When torque is communicated to the tubular member of the anchor, the tubular member will rotate within the drag assembly, which is prevented from rotating by means of the dragging engagement of the drag means with the casing. Because the slip assembly is secured to rotate with the drag assembly, the tubular member will also rotate within the slip housing. This causes the cam surfaces to be driven under the slip members to drive the slip members from a retracted position to an extended position whereby the slip members engage against the casing wall. This prevents further rotation of the attached tubing string.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DESCRIPTION OF THE PREFERRED EMBODIMENTS

Figure 1:
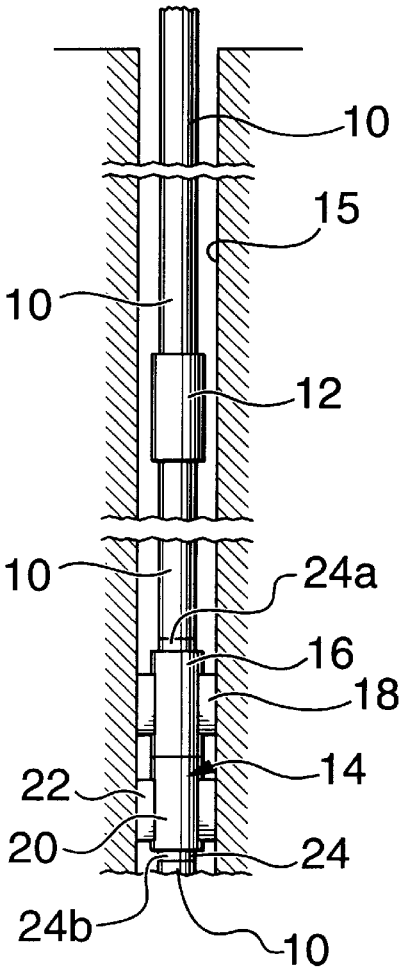
FIG. 1 is a front elevation of a production string including an anchor according to the present invention.
Figure 2:
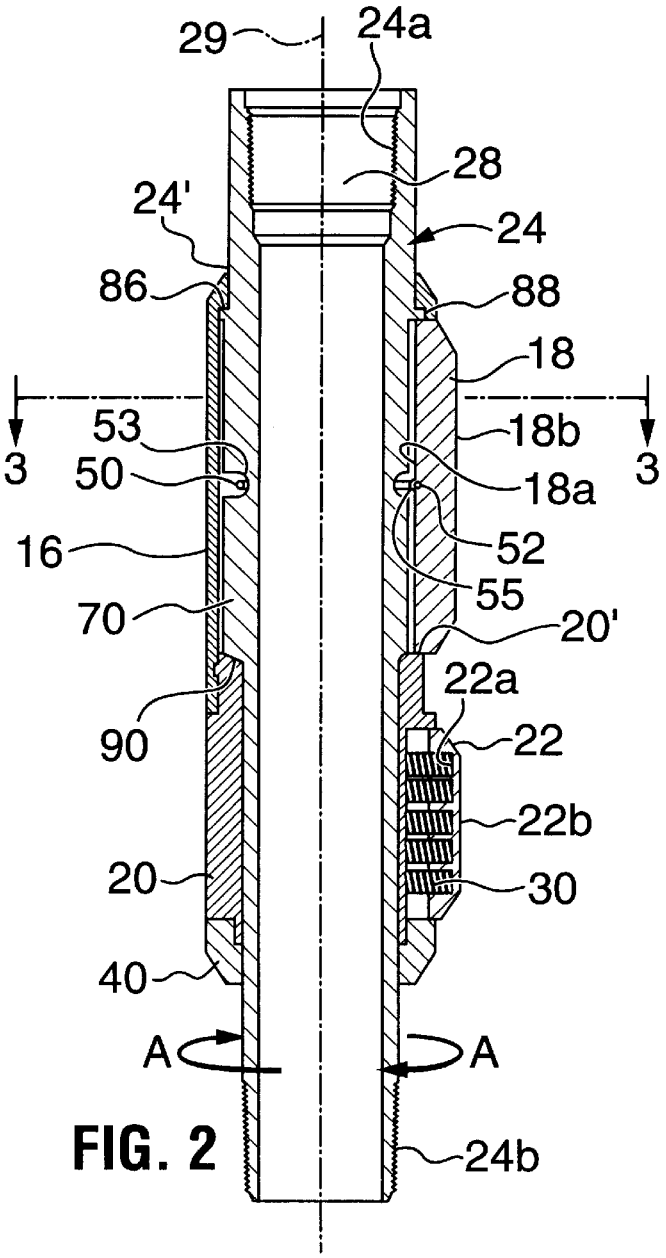
FIG. 2 is a sectional view along the long axis of an embodiment of an anchor according to the present invention.
Figure 3:
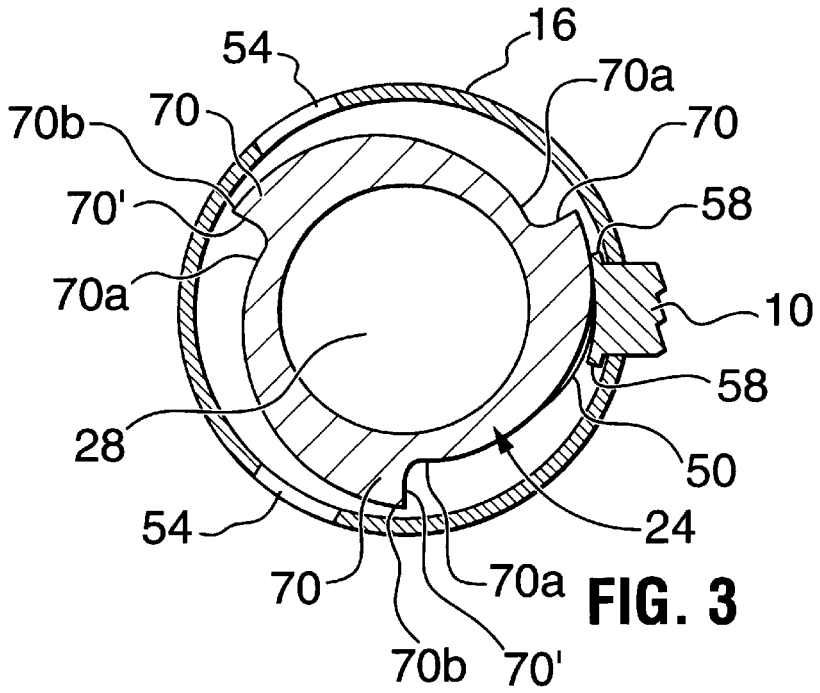
FIG. 3 sectional view along line 3—3 of FIG. 2 with only one slip member in position.
Figure 4:
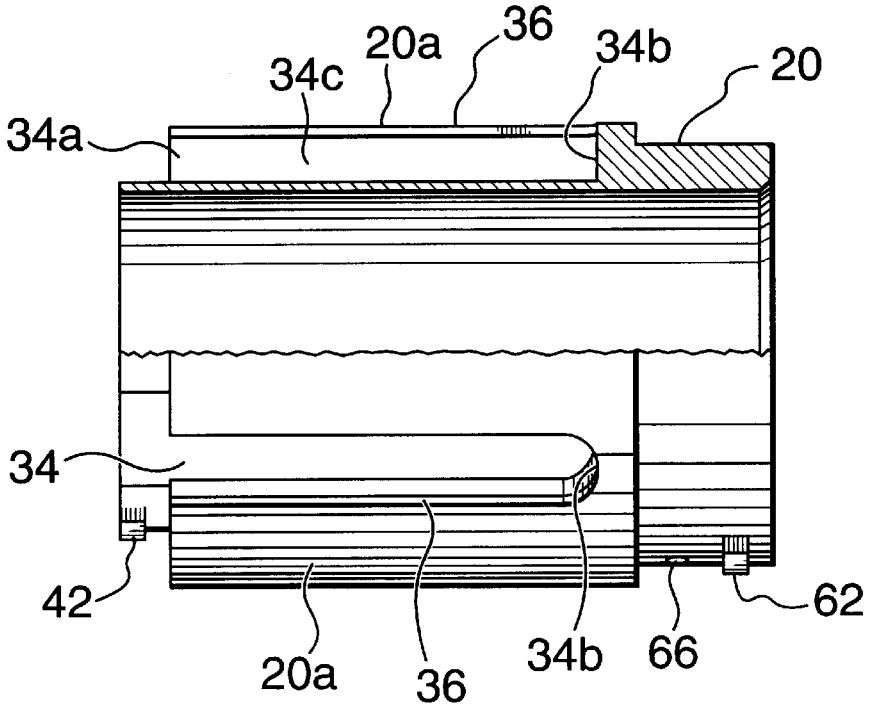
FIG. 4 is a side elevation view, shown partially in section, of a drag housing useful in the present invention.
Figure 5:
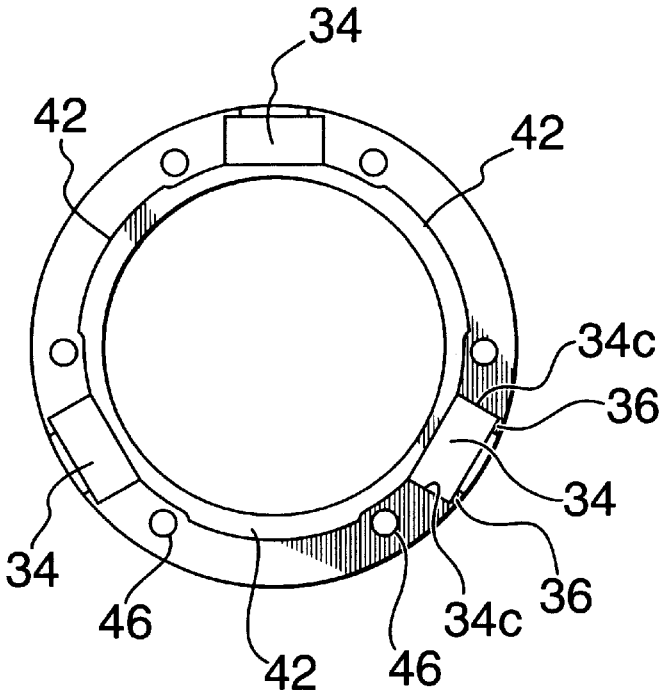
FIG. 5 is an end elevation view of the drag housing of FIG. 4.
Figure 7:
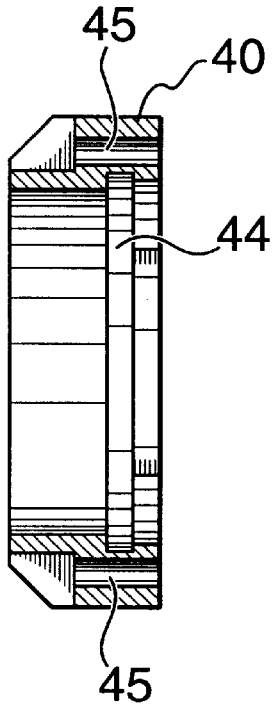
FIG. 7 is a sectional view through a retaining ring useful with the drag housing of FIG. 4.
Figure 6A:
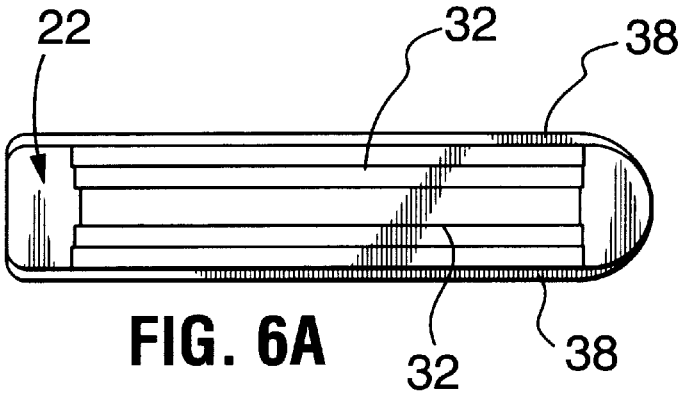
FIGS. 6A and 6B are top plan and front elevation views, respectively, of a drag block useful with the drag housing of FIG. 4.
Figure 6B:
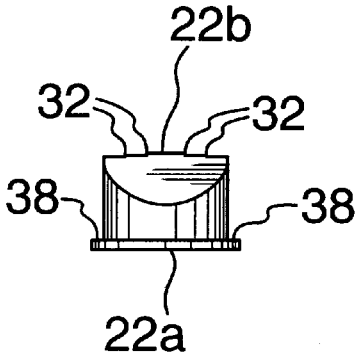
Figure 8:
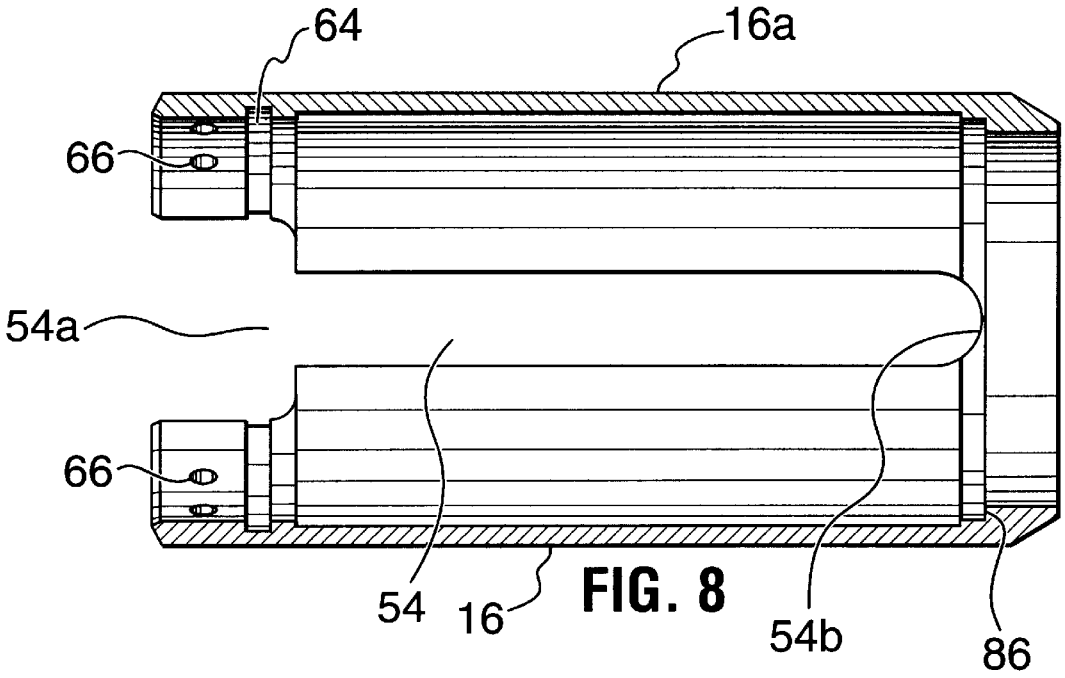
FIG. 8 is a sectional view through a slip housing useful in the present invention.
Figure 9A:
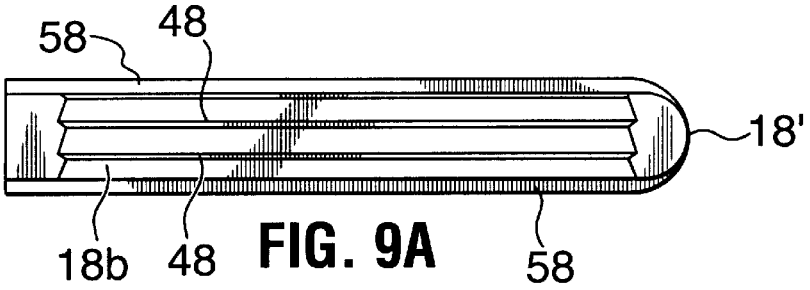
FIGS. 9A and 9B are top plan and side elevation views, respectively, of a slip member useful with the slip housing of FIG. 8.
Figure 9B:
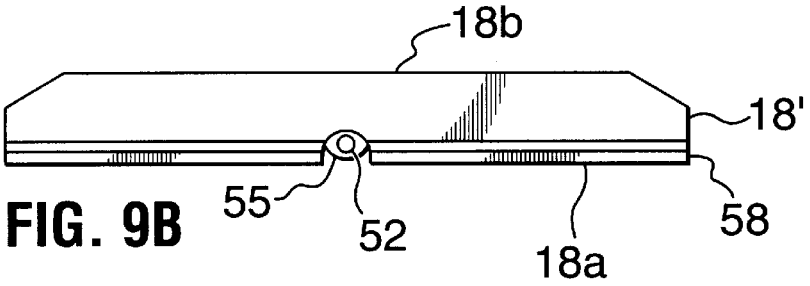

Referring to FIG. 1, a production tubing string 10 is shown including a rotary pump 12 and a downhole anchor 14 according to the present invention. Production tubing string 10, rotary pump 12 and downhole anchor 14 are positioned within a borehole 15 lined with casing.

Downhole anchor 14 includes a slip housing 16, carrying slip members 18, and a drag housing 20, carrying drag blocks 22. Slip housing 16 and drag housing 20 are mounted about a central tubular member 24.

Tubular member 24 of the downhole anchor is threadably engaged at its upper end 24*a* and at its lower end 24*b* into tubing string 10 such that rotational forces imparted to tubing string 10 will be translated to tubular member 24. Downhole anchor 14 is provided to act against the rotation forces imparted to the tubular member 24 and tubing string 10 and to anchor the string against rotational movement.

Referring to FIGS. 2 to 9B, one embodiment of an anchor according to the present invention is shown. Tubular member 24 of the anchor includes an upper box end 24*a* and a lower pin end 24*b* for threaded connection into a tubing string such as tubing string 10 of FIG. 1. The anchor is useful for preventing rotation of the tubing string in the direction as indicated by arrow A.

A bore 28 extends through the tubular member for passage of fluids therethrough. Bore 28 extends generally along the long axis 29 of the anchor.

On the outer surface 24' of the tubular member 24 is mounted a drag housing 20. Drag housing 20 is generally cylindrical and is rotatable about tubular member 24. Drag blocks 22 are mounted in housing 20 and are biased radially outwardly therefrom by springs 30. Drag blocks 22 include a back side 22*a* against which springs 30 act and an engaging face 22*b*, which is preferably knurled, roughened or, as shown, has teeth 32 formed thereon. Teeth 32 are preferably elongate in a direction parallel to the long axis 29 of the anchor which assist in frictional engagement of the drag blocks with the casing, as will be discussed hereinafter.

In an alternate embodiment, belly springs are used in place of the drag blocks and springs, as is known. The function of either the drag block or the belly spring is to engage against the casing of the borehole in which the anchor is to be used. This provides the drag housing with some resistance to rotational movement, although the resistance is slight and can relatively easily be overcome. Thus, the drag block or belly spring biases against the borehole wall when the tubing is raised or lowered within the casing, but does not bias sufficiently strongly to prevent such raising or lowering. It also resists rotation of the tubular member, but not enough to prevent such rotation.

The illustrated embodiment, shows a preferred mounting arrangement for the drag blocks which facilitates assembly and repair of the anchor. In particular, on one edge of drag housing 20 is formed a plurality of slots 34. Each slot includes an open end 34*a* along the edge of drag housing 20, a closed end 34*b* and side walls 34*c* extending between ends 34*a*, 34*b*. Each slot opens to outer surface 20*a* of drag housing. Flanges 36 extend from side walls 34*c* over a portion of the slot opening. The slots accept the drag blocks and springs. Drag blocks 22 are formed to have a width to closely fit into the space between side walls 34*c*. Shoulders 38 are formed on the drag blocks to retain against flanges 36 and thereby retain the drag blocks in the slot against the force of the springs. In a preferred embodiment, as shown, each slot includes a back wall 34*d* so that the drag springs do not have to bear against the tubular member.

A drag block 22 can be mounted in housing 20 by first compressing the springs against back side 22*a* of the block. The block is then pushed into a slot through open end 34*a* thereof until it abuts against end wall 34*b*. Shoulders 38 engage against flanges 36 and maintain the drag block in the slot. Drag blocks 22 are maintained in the slots by a retaining ring 40 releasably secured against the edge of the drag housing 20 and over open ends 34*a* of the slots. Retaining ring 40 is retained on the drag housing by engagement of lock ring sections 42 on the housing which fit into a groove 44 on the retaining ring and by securement of screws (not shown) through apertures 45 in the ring and into apertures 46 formed in the housing. Other means for retaining the drag blocks in the slots can be used, as desired. However, a removable retaining means is preferred to facilitate replacement of the drag blocks. As will be understood, drag blocks 22 can be replaced by simply removing the retaining ring and pulling the drag blocks out of their slots.

Mounted above drag housing 20 is slip housing 16. Slip housing 16 is generally cylindrical and is rotatable with drag housing 20 about tubular member 24. Three slip members 18 are preferably equidistantly mounted about housing 16. Each slip member has a back side 18*a* and an engaging face 18*b*. Engaging face 18*b* has formed thereon teeth 48 which are elongate in a direction substantially parallel with the long axis 29 of the anchor. The outer edges of teeth 48 are preferably sharpened and the teeth incline in a direction opposite the direction (arrows A) in which the tubing string will be rotated. Teeth 48 act to engage against the casing to anchor the tool against further rotation in the borehole, as will be discussed hereinafter.

The slip members are normally biased radially inwardly toward tubular member 24 by a ring spring 50. Ring spring 50 engages through apertures 52 formed in the back sides 18*a* of the slip members. An annular groove 53 can be formed in tubular member 24 to accept ends of ring spring 50 and protrusions 54 formed on the back sides of the slip members to facilitate alignment of the slip members on the tubular member.

The illustrated embodiment, shows a preferred mounting arrangement for the slip members which facilitates assembly and repair of the anchor. In particular, a plurality of slots 54 extend from one edge of the slip housing. Each slot includes an open end 54*a* along the edge of the housing, a closed end 54*b* and side walls 54*c* extending between ends 54*a*, 54*b*. Each slot opens to outer surface 16*a* of the slip housing and extends from the inner surface to the outer surface of the slip housing. The slots accept the slip members. In particular, the slip members are of a height such that when the slips are in position and biased against the tubular member, they extend to be acted outwardly from the slip housing through the slots and are driven by the side walls of the slots to be rotated with the slip housing. Slip members 18 are formed to have a width to closely fit into the space between side walls 54*c*. This provides stability to the slip members and provides for good transmission of forces from the slip housing to the slip members. Preferably, shoulders 58 are formed on each slip member to prevent the slip members from passing entirely through the slots, for example, where ring spring 50 should fail.

A slip member can be mounted in the slip housing by sliding the slip member into a slot through the slot's open end 54*a* until it abuts against end wall 54*b*. Shoulders 58 engage against sidewalls 54*c* and maintain the slip member in the slot. The slip members can be inserted into the housing prior to mounting the housing on the tubular member. However, preferably the slip members are mounted into the slots after the housing is mounted on the tubular member. The slip housing and the way in which the slip members mount within the slip housing provide an anchor which is preferred over previous anchors and, especially, those previous anchors having inwardly biased slip members. Since these prior anchors have springs which act between the housing and the slip members to bias the slip members radially inwardly, assembly requires mounting the slips into the slip housing prior to fitting the housing over the tubular member or, alternately, inserting the slip members between the tubular member and the housing and attempting to align the slip members with their openings.

To prevent reverse assembly, wherein the slips are mounted with their teeth inclining in the wrong direction, preferably, the slot is formed to only accept the slip members in one direction. In one embodiment, the closed end of the slot and one end of the slip member are correspondingly shaped so that the slip member at one end mates with the closed end of the slot while the other end of the member is shaped in such a way that it does not mate with the closed end of the slot and, therefore, prevents the slip member from fitting properly into the slot. As shown in the illustrated embodiment, closed end 53*b* and end 18' of the slip member are correspondingly rounded, but can be shaped in any other way, to mate.

Slip members 18 are maintained in the slots by a retaining means. In the illustrated embodiment, the retaining means is an end 20' of the drag housing 20 which is secured against the edge of the slip housing 16 and over open ends 54*a* of the slots. In one embodiment, the drag housing and the slip housing are secured together by releasable means such as lock ring sections 62 on the drag housing which fit into a groove 64 on the slip housing. Bolts (not shown) can be secured between the housings in apertures 66 to reinforce the connection. Other means for retaining the drag housing to the slip housing can be used, as desired. However, a releasable connection is preferred to facilitate replacement of the slip members. As will be understood, the slip members can be replaced by simply removing the drag housing, expanding the ring spring and pulling the slip members out of the housing.

While slip members 18 are normally biased inwardly in slots 54 against tubular member 24, they can be urged radially outwardly from housing 16 through the slots, as limited by abutment of shoulders 58 against sidewalls 54*c*, by application of force against the tension in spring 50.

Tubular member 24 includes a plurality of spaced apart cams 70, there being one cam positioned to act upon each slip 18 of the slip housing. Cams 70 each extend outwardly from the tubular member with their profile increasing from a surface, indicated at 70*a*, which is flush with the outer surface of the remainder of the tubular member to a maximum outwardly extending surface, indicated at 70*b*. The profiles of cams 70 increase in a direction opposite the direction in which the tubing string will be rotated (arrows A). Where groove 53 is formed on tubular member each cam 70 includes an upper portion and a lower portion aligned longitudinally on both sides of the groove.

When slip housing 16 is positioned over tubular member 24 such that cams 70 are positioned against the back sides of slips 18, the slips can be actuated to be driven outwardly by the force of the cams 70 against the slips. In particular, if surfaces 70*a* are positioned below slip members 18 and the tubular member is rotated within the slip housing in the direction indicated by arrows A, slip members 18 will be driven outwardly as the increasing profile of cams 70 ride under slips 18. The rotation of the tubular member within the slip housing in the direction of the arrows A will be limited by the wedging of shoulder 58 between the maximum outwardly extending surface 70*b* of the cam. Rotation of tubular member within housing 16 in a direction opposite to arrows A is limited by abutment of slip members against the rear sides 70' of cams 70.

The slip housing 16 and drag housing 20 are connected together, as discussed hereinbefore. This assembly is mounted for rotational movement about the tubular member in any suitable way. In the illustrated embodiment, slip housing 16 has an inner shoulder 86 which engages on an annular ring 88 on tubular member 24 to prevent downward relative movement of the housing assembly over the tubular member. In addition, tubular member has a reduced diameter which forms shoulder 90 and drag housing 20 has a reduced inner diameter relative to slip housing. The edge 16' of the drag housing, therefore, abuts against shoulder 90 to prevent upward relative movement of the housing assembly over the tubular member. Other means can be used, as desired, to prevent movement of the housing assembly along the length of the tubular member.

In use, the anchor is inserted into the well to prevent rotation of a member, such as tubing string 10 and pump 12 within the well. For raising and lowering the tubing string and anchor in the well, the slip housing is rotated so that slip members 18 are retracted (i.e. the slip members are not positioned over a cam). In this position, the teeth of the slip members do not engage against the casing. However, when the anchor is in place, and pump 12 is started, rotational torque is imparted to tubing 10 which causes it to turn within the casing. This rotational torque is conveyed to tubular member 24. The anchor shown in the Figures is intended to be used against torque which causes the tubing to turn in the direction as shown by arrows A. Drag blocks 22, which are always in contact with the casing, provide a certain measure of drag against such rotation, although their force is not strong enough to prevent it. As drag housing 20 is initially prevented from turning with tubing 10 and tubular member 24, the tubular member rotates within the drag housing. Since slip housing 16 is secured to drag housing 20, tubular member 24 also rotates within slip housing 16. This causes cams 70 to be driven under slip members 18 and to urge them outwardly against the tension in spring 50. Slip members 18 will be urged radially outwardly until teeth 48 contact the casing. Further rotation of the tubular member will cause teeth 48 to bite into the casing. The slip members then act as a wedge between cam 70 and the casing. Such wedging effectively prevents further turning of tubular member 24 and the tubing to which the tubular member is attached. Preferably, this wedging occurs before the shoulders of the slip members come into contact with the slip housing. In particular, the combined radial length of a slip member positioned between the flush surface 70*a* and the maximum outwardly extending surface 70*b* of the cam is selected to be greater than the internal radius of the casing in the borehole wherein the anchor is to be used. By providing locking prior to the shoulders of the slip contacting the housing, application of excessive force on the slip housing which could cause deformation of the housing is prevented.

When it is desired to permit movement of the tubing 10 relative to the casing, the tubing is rotated in a direction opposite to that indicated by arrows A. This drives cams 70 from under the slip members. The slip members will then retract by the tension in spring 50 and will no longer engage against the casing to oppose rotation of the tubular member and its attached tubing sting.

It will be apparent that many changes may be made to the illustrative embodiments, while falling within the scope of the invention and it is intended that all such changes be covered by the claims appended hereto.

What is claimed is:

1. A downhole tool for preventing rotational movement of a member within a well comprising an elongate tubular member having a central axis; a drag housing carrying drag means and being mounted on and rotatable about the tubular member; a slip housing disposed about the tubular member and secured to the drag housing to rotate with the drag housing about the tubular member, the slip housing including at least two slots extending from an edge thereof, each slot including an open end and a closed end and an open face opening to the outer surface of the slip housing, each slot retaining a slip member, the slip members each being normally biased inwardly toward the tubular member and being retained in the slot to move with the slip housing and cam means on the outer surface of the tubular member including an outwardly extending cam surface for each slip member, the slip housing positioned over the cam means so that the cam surfaces can ride under the slip members to urge them radially outwardly through the slots.

2. The downhole tool as defined in claim 1 wherein the drag means are selected from the group consisting of outwardly spring-biased drag blocks or belly-type springs.

3. The downhole tool as defined in claim 1 comprising three drag means equidistantly spaced about the perimeter of the drag housing.

4. The downhole tool as defined in claim 1 comprising three slip members spaced equally about the circumference of the housing.

5. The downhole tool as defined in claim 1 further comprising a releasable slip member retaining means extending over the open ends of the at least two slots to retain the slip members in the at least two slots.

6. The downhole tool as defined in claim 5 wherein the releasable retaining means is an end of the drag housing.

7. The downhole tool as defined in claim 1 wherein the slip members are formed to slide into the at least two slots through the open end thereof and be retained between the slip housing and the tubular member, each slip member having an engaging section which is extendable through the open face of the slot.

8. The downhole tool as defined in claim 1 wherein the closed ends of the at least two slots have a selected shape and one selected end of each slip member is shaped to mate with the selected shape of the closed ends.

9. The downhole tool as defined in claim 1 wherein the slip member has a width selected to fit closely into the slot.

10. The downhole tool as defined in claim 1 wherein each slip member is biased radially inwardly by a biasing means acting between the tubular member and the slip member.

11. The downhole tool as defined in claim 10 wherein the biasing means are springs carried by the slip members.

12. The downhole tool as defined in claim 10 wherein the biasing means is one spring which acts for all of the slip members.

13. A downhole tool for preventing rotational movement of a member within a well comprising an elongate tubular member having a central axis; a drag housing carrying drag means and being mounted on and rotatable about the tubular member; a slip housing disposed about the tubular member and secured to the drag housing to rotate with the drag housing about the tubular member, the slip housing including a plurality of slots each slot retaining a slip member, the slip member each being biased inwardly toward the tubular member by biasing means acting between the slip members and the tubular member and being retained in the slot to move with the slip housing and cam means on the outer surface of the tubular member including an outwardly extending cam surface for each slip member, the slip housing positioned over the cam means so that the cam surfaces can ride under the slip members to urge them radially outwardly through the slots.

14. The downhole tool as defined in claim 13 wherein the drag means are selected from the group consisting of outwardly spring-biased drag blocks or belly-types springs.

15. The downhole tool as defined in claim 13 comprising three drag means equidistantly spaced about the perimeter of the drag housing.

16. The downhole tool as defined in claim 13 comprising three slip members spaced equally about the circumference of the housing.

17. The downhole tool as defined in claim 13 wherein the slip members are formed to slide into the at least two slots through an open end thereof and be retained between the slip housing and the tubular member, each slip member having an engaging section which is extendable through the slot.

18. The downhole tool as defined in claim 13 wherein the biasing means are carried by the slip members.

19. The downhole tool as defined in claim 13 wherein the biasing means is one spring which extends to engage all of the slip members.

* * * * *